US007884795B2

(12) United States Patent
Cho et al.

(10) Patent No.: US 7,884,795 B2
(45) Date of Patent: Feb. 8, 2011

(54) GATE DRIVER HAVING A PLURALITY OF SHIFT REGISTERS, DRIVING METHOD THEREOF AND DISPLAY DEVICE HAVING THE SAME

(75) Inventors: NamWook Cho, Gunpo-si (KR); SooYoung Yoon, Goyang-si (KR); MinDoo Chun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 835 days.

(21) Appl. No.: 11/320,360

(22) Filed: Dec. 28, 2005

(65) Prior Publication Data

US 2006/0221042 A1 Oct. 5, 2006

(30) Foreign Application Priority Data

Mar. 31, 2005 (KR) ..... 10-2005-0027268

(51) Int. Cl.
*G09G 3/36* (2006.01)

(52) U.S. Cl. ..... 345/100; 345/98

(58) Field of Classification Search ..... 345/98–100, 345/87, 103; 377/64–81
See application file for complete search history.

(56) References Cited

U.S. PATENT DOCUMENTS 5,812,284 A * 9/1998 Mizutani et al. ..... 358/482
5,859,630 A * 1/1999 Huq ..... 345/100
6,362,643 B1 * 3/2002 Kim ..... 324/770
6,611,248 B2 * 8/2003 Kanbara et al. ..... 345/100
2003/0184512 A1 * 10/2003 Hayashi et al. ..... 345/100
2003/0227433 A1 * 12/2003 Moon ..... 345/100
2004/0150610 A1 * 8/2004 Zebedee et al. ..... 345/100
2004/0174334 A1 * 9/2004 Washio et al. ..... 345/102
2005/0156856 A1 * 7/2005 Jang et al. ..... 345/100
2005/0201508 A1 * 9/2005 Shin et al. ..... 377/10
2006/0221041 A1 * 10/2006 Cho et al. ..... 345/100

* cited by examiner

*Primary Examiner*—Chanh Nguyen
*Assistant Examiner*—Long Pham
(74) *Attorney, Agent, or Firm*—Brinks Hofer Gilson & Lione

(57) ABSTRACT

A display device is set forth that comprises a display panel having a plurality of pixels arranged in a matrix. A data driver supplies pixel drive signals to data lines that are connected to drive the individual pixels of at least one row of pixels with corresponding pixel drive signals. The display device also includes a gate driver that supplies gate drive signals to the gate lines of the matrix. Each gate line may be connected to concurrently drive at least one row of pixels with a respective gate drive signal. The gate driver may comprise a sequence of shift registers that are connected in cascade with one another and two or more phase clocks that are connected to drive the sequence of shift registers. The shift registers of the gate driver may be interconnected with one another so that a shift register to which a given phase clock is applied is reset using an output signal from a next occurring shift register in the sequence of shift registers that is also connected to the given phase clock.

19 Claims, 10 Drawing Sheets

GATE DRIVER HAVING A PLURALITY OF SHIFT REGISTERS, DRIVING METHOD THEREOF AND DISPLAY DEVICE HAVING THE SAME

BACKGROUND OF THE INVENTION

1. Field of the Invention

The present invention relates to a gate driver. More particularly, the present invention relates to a gate driver capable of providing a reliable output signal and a display device that employs the gate driver.

2. Description of the Related Art

Display devices for displaying an image by controlling pixels arranged in a matrix have been widely used. Examples of such display devices are liquid crystal display devices (LCD) and organic light emitting diode devices (OLED). Such display devices typically include a display panel having pixels arranged in a matrix, a gate driver for selectively providing a drive signal to rows of pixels on a line by line basis, and a data driver for providing drive signals to the pixels.

Display devices having a gate driver and/or a data driver embedded on the display panel have been developed. Such display devices attempt to achieve the advantages of a low manufacturing cost, a process simplification, lightness and slimness. When manufacturing the display panel, the gate diver and/or the data driver are/is concurrently manufactured. To this end, a plurality of thin film transistors (TFTs) are provided to control each of the pixels in the display panel, and the gate driver and/or the data driver can be manufactured through the same semiconductor process as the TFT.

The gate drivers of the display device typically include a plurality of shift registers for providing the requisite output signals used to drive individual rows of pixels. There may be a one-to-one correspondence between each gate line and driver. For example, when the display panel has ten gate lines, at least ten shift registers are provided to provide the corresponding output signals to the ten gate lines, respectively.

FIG. 1 is a block diagram of one embodiment of a known gate driver. As shown, the gate driver includes a plurality of shift registers SRC1 through SRC[N+1] connected in cascade to each other. In this cascade arrangement, the output terminal OUT of each shift register is connected to the set terminal SET of the next shift register. The shift registers include N shift registers SRC1 through SRC[N] corresponding to N gate lines, and a dummy shift register SRC[N+1] that is used to reset the last shift register SRC[N].

The first shift register SRC1 is set by a pulse start signal STV. The pulse start signal is synchronized with a vertical synchronization signal Vsync. Each of the shift registers SR2 through SRC[N+1] is set by the output signal of the immediately preceding shift register in the shift register sequence. When there are N gate lines, output signals GOUT1 through GOUT[N] of the shift registers are connected to the corresponding gate lines, and an output signal GOUT[N+1] of the dummy shift register SRC[N+1] is not connected to any gate line.

A first clock CKV is supplied to the odd-numbered shift registers SRC1, SRC3, . . . , and a second clock CKVB is supplied to the even-numbered shift registers SRC2, SRC4, . . . . Here, the phase of the first clock CKV is opposite to that of the second clock CKVB. The first clock CKV is connected to drive the odd-numbered shift registers SRC1, SRC3, . . . , and the second clock CKVB is connected to drive the even-numbered shift registers SRC2, SRC4, . . . . The pulse start signal STV is applied to the first shift register SRC1 when the second clock CKVB is high.

The shift registers SRC1 through SRC[N] provide the respective output signals GOUT1 through GOUT[N] in synchronization with the first clock CKV or the second clock CKVB. Each of the shift registers SRC1 through SRC[N] is reset by the output signal of the shift register that immediately follows it in the shift register sequence. However, since there is no shift register subsequent to the dummy shift register SRC[N+1], the dummy shift register SRC[N+1] is reset by its own output signal GOUT[N+1].

FIG. 2 is a circuit diagram of the first and second shift registers illustrated in FIG. 1, while FIG. 3 is a waveform diagram showing the signals used to drive the first shift register of FIG. 2. Since each of the shift registers illustrated in FIG. 1 is identical in structure with the other, only the first shift register SRC1 is described in connection with FIGS. 2 and 3 for convenience.

When the pulse start signal STV is high, the first clock CKV and the second clock CKVB are low and high, respectively. Referring to FIGS. 2 and 3, the first shift register SRC1 is set by a high state of the pulse start signal STV during a cycle of the second clock (CKVB) period. More particularly, when the pulse start signal STV is applied, a node Q is charged to the voltage of the pulse start signal STV. A first transistor M1 is turned on by the voltage of the node Q. The node QB is then discharged by the voltage difference (VDD−VSS) that exists between a first power supply voltage and a second power supply voltage. As a result, the node QB is driven to and maintained at a low voltage level corresponding to the ratio of a resistance Rl of the first transistor M1 and a resistance R6 of a sixth transistor M6.

During a first clock (CKV) period, the first output signal GOUTl is provided in response to the first clock CKV signal. More particularly, when the first clock CKV is applied to the second transistor M2, a voltage boost results from pumping the drain-gate capacitance Cgd of the second transistor M2. Thus, the node Q is charged to a voltage level that is higher than the voltage level of the charged pulse start signal STV. Accordingly, the second transistor M2 is turned on and the first clock CKV is provided as the first output signal GOUT1.

During the second clock (CKVB) period, the first shift register SRC1 is reset by the output signal GOUT2 of the next shift register SRC2 in the shift register sequence. More particularly, when the fifth transistor MS is turned on by the second output signal GOUT2 of the shift register SRC2, the node Q is discharged by the first power supply voltage VSS through the fifth transistor M5. Additionally, the first transistor M1 is driven to a nonconductive state by the voltage now found at node Q. The node QB is charged using the second supply voltage VDD connected to the node QB through the sixth transistor M6. This causes the third and fourth transistors M3 and M4 to enter a conductive state. Accordingly, node Q is discharged to the first supply voltage VSS through the conductive fourth transistor M4. In this case, most of the output signal GOUT1 is discharged through the source-drain path of the second transistor M2, and the remaining output signal GOUTl is discharged to the first power supply voltage VSS through the conductive third transistor M3.

However, an undesired output signal may be generated from each of the shift registers SRC1 through SRC[N] in this known gate driver arrangement. As illustrated in FIG. 4, when a gate drive signal GOUT[N] is provided from the Nth shift register SRC[N] by the second clock CKVB, spurious drive signals are also provided from the second and fourth output signals GOUT2 and GOUT4 as well as from all even-numbered shift registers SRC2 and SRC4 to which the second clock CKVB is applied. More particularly, in addition to the desired drive signal, a plurality of undesired drive signals may be provided during one clock period.

The shift registers SRC1 through SRC[N] output drive signals at the corresponding output GOUT1 through GOUT [N] once a frame. For example, the fourth shift register SRC4 provides the fourth output signal GOUT4 during a period of the second clock signal (CKVB), but does not output the drive signal during the remaining period (90%) of one frame. To drive the fourth shift register in this manner, the third transistor M3 of the fourth shift register SRC4 must be turned on and, thus, node QB, which is connected to the third transistor M3, always maintains a high state during the remaining frame period. When this operation is repeated for each frame, the third and fourth transistors M3 and M4 are degraded. Accordingly, the threshold voltages of the third and fourth transistors M3 and M4 are shifted and, thus, the transistors M3 and M4 cannot be readily driven to a non-conductive state. In serious cases, the fourth transistor M4 is not driven to a non-conductive state and, thus, node Q is not reset. The output signals from the shift register therefore provide spurious drive signals at undesired times in response to the first or second clock CKV or CKVB.

Taking this into consideration for all the shift registers SRC1 through SRC[N], when the sixth drive signal GOUT6 is provided from the sixth shift register SRC6 as a result of the second clock signal CKVB, spurious drive signals are also provided at the second and fourth outputs GOUT2 and GOUT4 as well as from each of the even-numbered shift registers SRC2, SRC4, SRC8, SRC10, . . . to which the second clock CKVB is applied. This causes the display device to malfunction (i.e., screen flickering, etc.) thereby degrading the reliability of the product.

SUMMARY OF THE INVENTION

A display device is set forth that comprises a display panel having a plurality of pixels arranged in a matrix. A data driver supplies pixel drive signals to data lines that are connected to drive the individual pixels of at least one row of pixels with corresponding pixel drive signals. The display device also includes a gate driver that supplies gate drive signals to the gate lines of the matrix. Each gate line may be connected to concurrently drive at least one row of pixels with a respective gate drive signal. The gate driver may comprise a sequence of shift registers that are connected in cascade with one another and two or more phase clocks that are connected to drive the sequence of shift registers. The shift registers of the gate driver may be interconnected with one another so that a shift register to which a given phase clock is applied is reset using an output signal from a next occurring shift register in the sequence of shift registers that is also connected to the given phase clock.

Various embodiment of the display device are set forth that employ a number N shift registers in the sequence of shift registers. In one embodiment, two phase clocks are employed, and the (N−2)th shift register of the sequence of shift registers is reset by an output signal of the Nth shift register. In another embodiment, three phase clocks are employed and the (N−3)th shift register of the sequence of shift registers is reset by an output signal of the Nth shift register. In a still further embodiment, four phase clocks are employed and the (N−4)th shift register of the sequence of shift registers is reset by an output signal of the Nth shift register.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A number of different gate driver embodiments are set forth below. In each embodiment, the gate driver includes a plurality of shift registers that are connected in cascade with one another as part of a sequence of shift registers. Each sequence of shift registers is driven by two or more phase clocks signals. A unique reset arrangement is employed for each shift register of the sequence of shift registers to reduce and/or eliminate the spurious drive signals noted in connection with the existing gate driver constructions. The following gate driver embodiments show implementations that use two phase clocks, as well as higher order phase clocks such as three phase clocks and four phase clocks. The phase clocks of each embodiment may be synchronized to one or more horizontal synchronization signals that are used to provide the timing necessary to generate an image on the corresponding display.

First Embodiment: Two Phase Clocks

Figure 1:
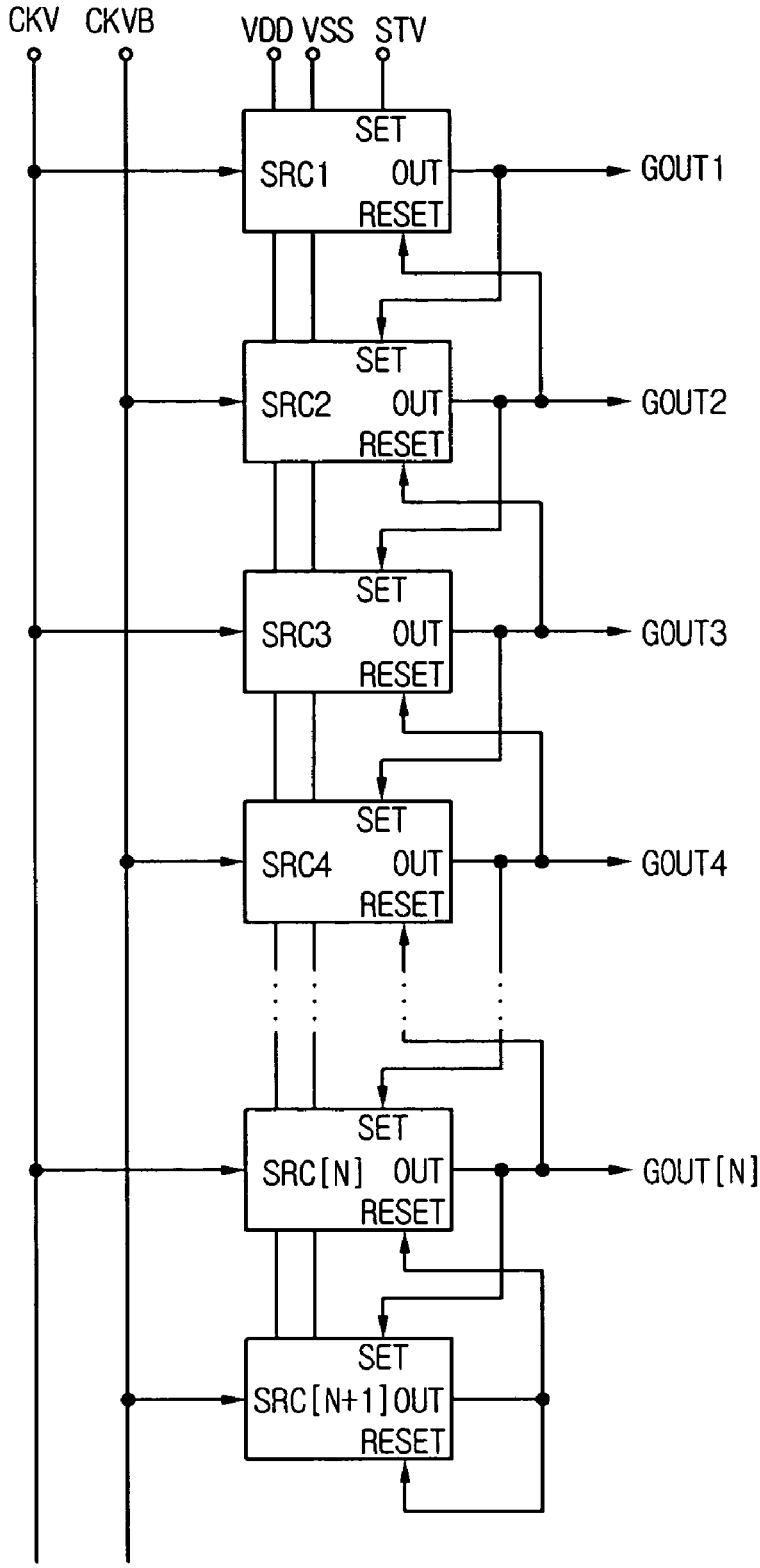
Fig.1 (Related Art)
FIG. 1 is a block diagram of one embodiment of a known gate driver.
Figure 2:
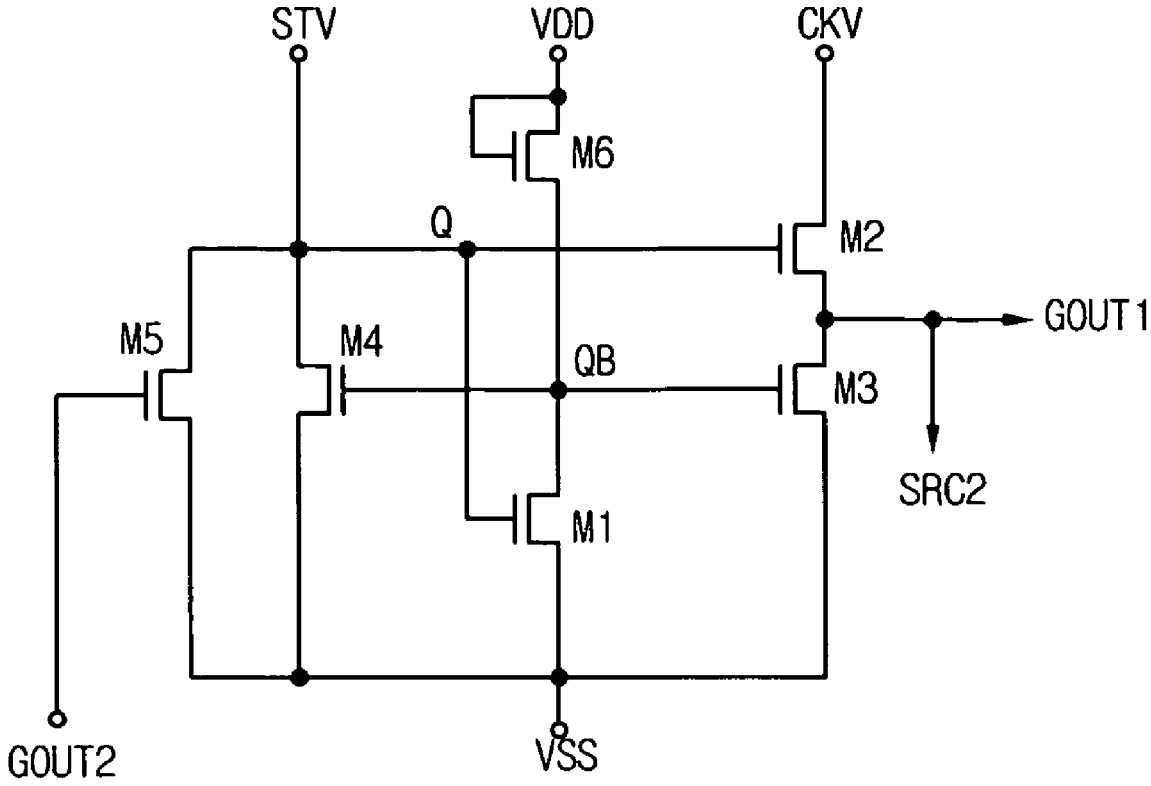
Fig.2 (Related Art)
FIG. 2 is a circuit diagram of a shift register that may be used in the gate driver shown in FIG. 1.
Figure 3:
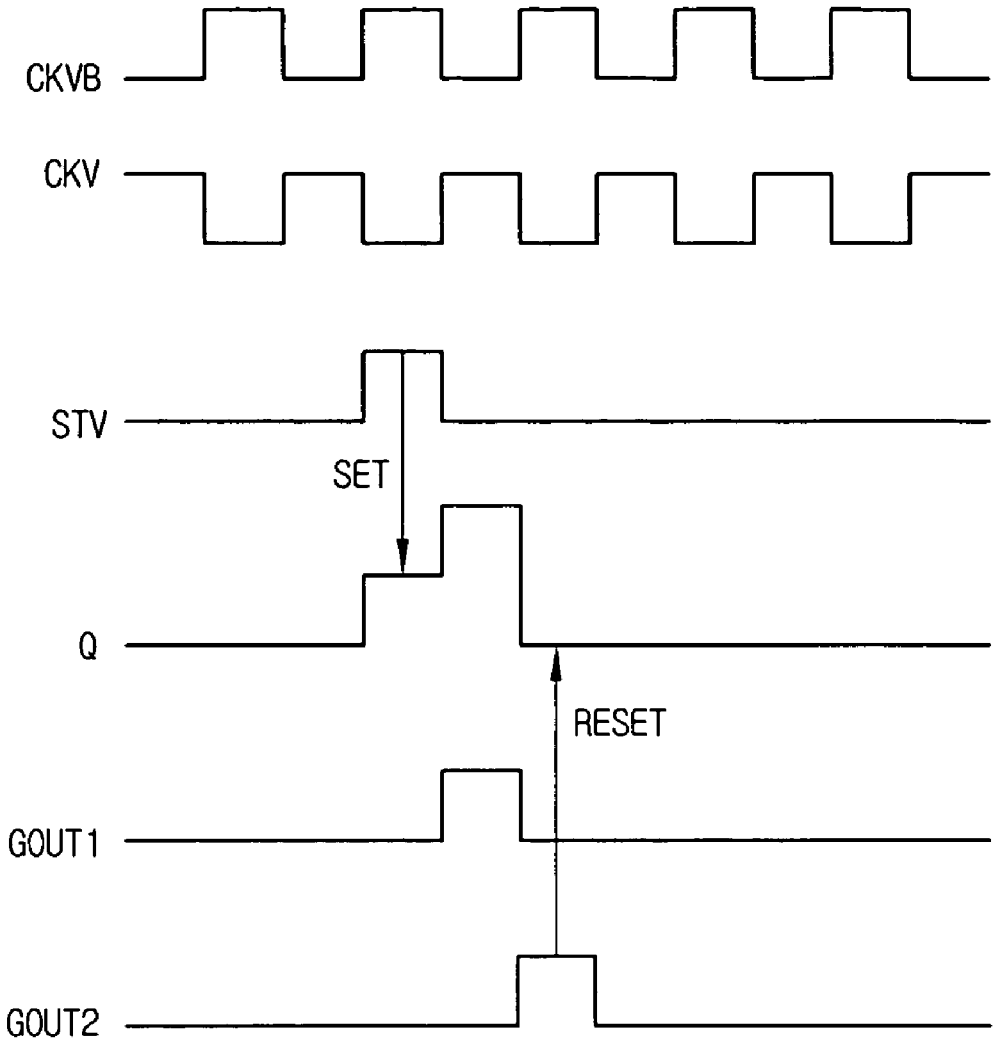
Fig.3 (Related Art)
FIG. 3 is a waveform diagram of various input and output signals associated with the shift register of FIG. 2.
Figure 4:
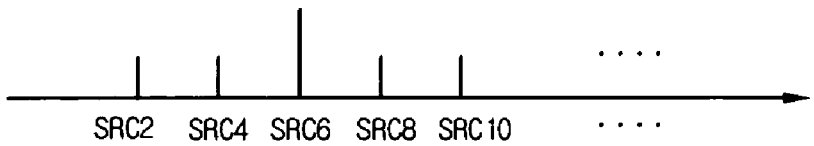
Fig.4 (Related Art)
FIG. 4 is a waveform diagram illustrating a plurality of spurious drive signals that may occur in connection with the gate driver shown in FIG. 1.
Figure 5:
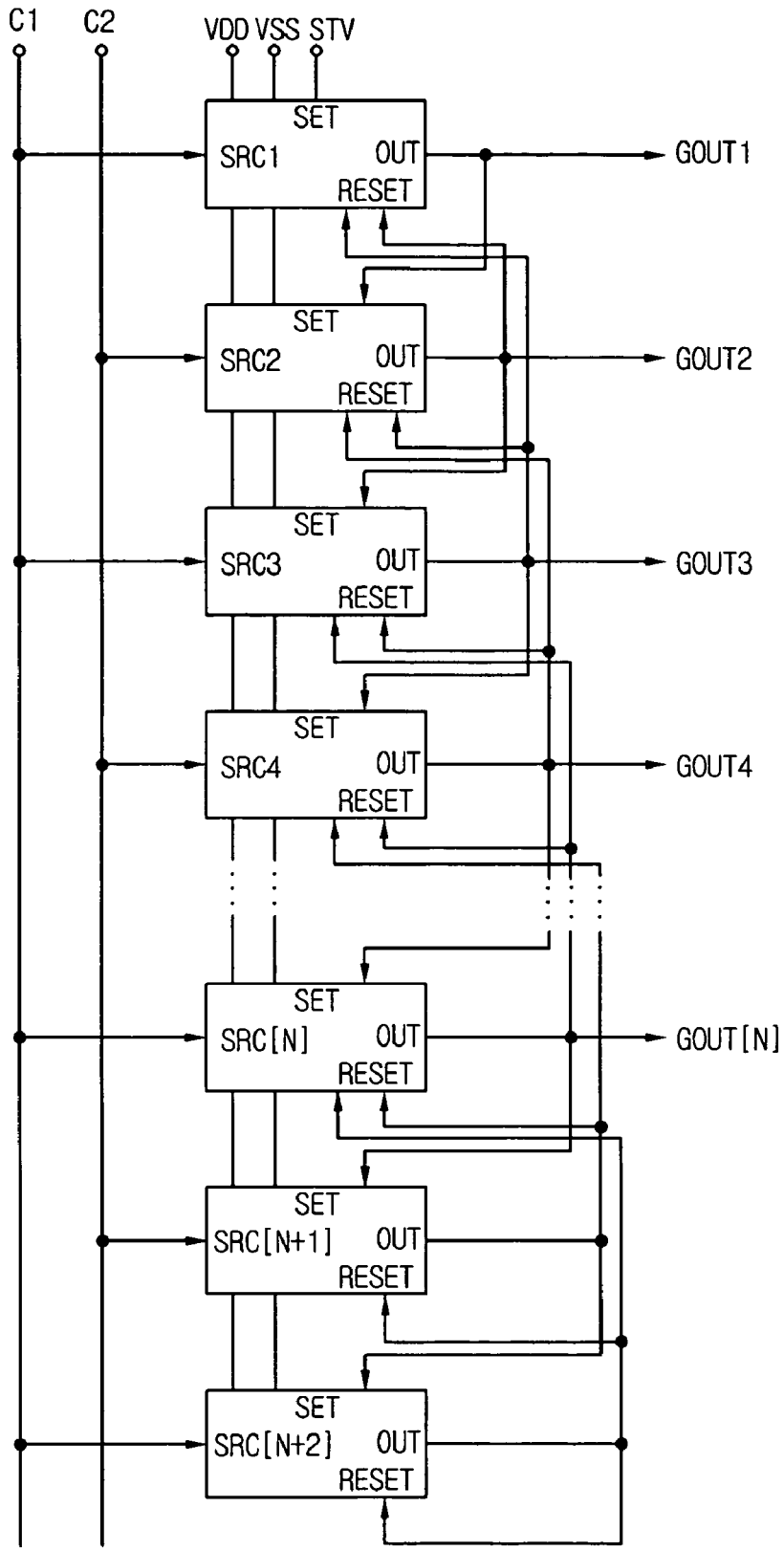
FIG. 5 is a block diagram of a first embodiment of a gate driver constructed in accordance with the teachings of the present invention.
Figure 6:
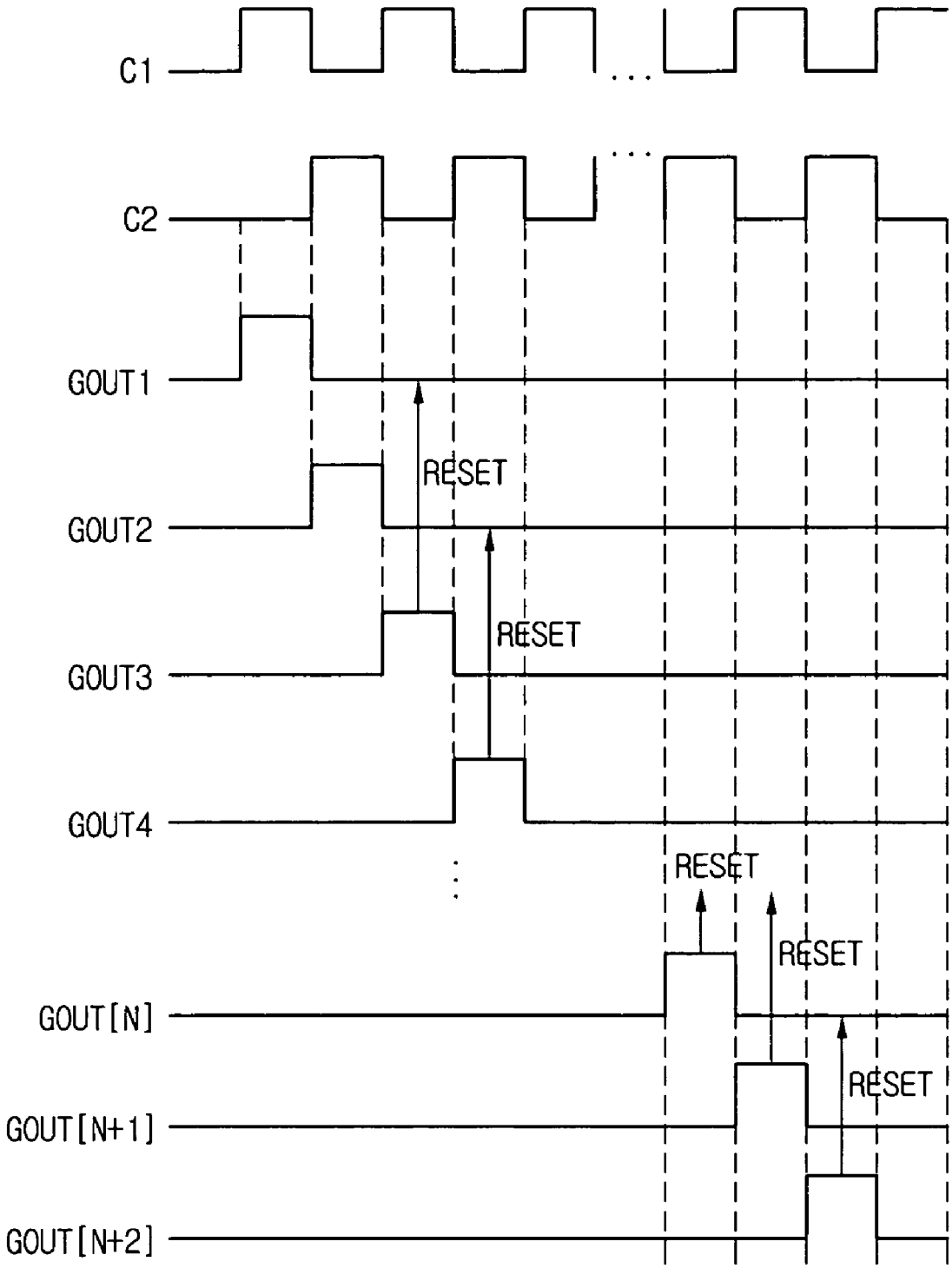
FIG. 6 is a waveform diagram showing various input and output signals associated with the embodiment of the gate driver shown in FIG. 5.

FIG. 5 is a block diagram of a first embodiment of a gate driver, while FIG. 6 is a waveform diagram of various input and output signals associated with the embodiment of the gate driver of FIG. 5. As shown, the gate driver of this embodiment includes N shift registers SRC1 through SRC[N] arranged in a cascading sequence and dummy shift registers SRC[N+1] and SRC[N+2]. The shift registers SRC1 through SRC[N] are respectively connected to one of two phase clocks. The two phase clocks include a first clock signal C1 and a second clock signal C2. More particularly, the first clock C1 is commonly connected to and concurrently applied to the odd-numbered shift registers SRC1, SRC3, . . . . The second clock C2 is commonly connected to and concurrently applied to the even-numbered shift registers SRC2, SRC4, . . . .

The shift registers SRC1 through SRC[N] provide corresponding gate drive signals GOUT1 through GOUT[N]. The gate drive signal GOUT1 through GOUT[N] of each shift register is also provided to the input of a set terminal of the next shift register in the shift register sequence, a reset terminal of the immediately preceding shift register in the shift register sequence, and a reset terminal of the second preceding shift register in the shift register sequence. In this example, the gate drive signal GOUT3 of the third shift register SRC3 is provided to the set terminal of the fourth shift register SRC4, the reset terminal of the second shift register SRC2, and the reset terminal of the first shift register SRC1. Accordingly, the gate drive signal of the current shift register is used to set the next shift register in the shift register sequence and to reset the preceding shift register and the second preceding shift register in the shift register sequence.

A first power supply voltage VSS and a second power supply voltage VDD are supplied to the shift registers SRC1 through SRC[N+2]. When each shift register is set, a node Q connected to the output terminal OUT of the shift register is charged using the second power supply voltage VDD. In contrast, when the shift register is reset, the node Q is discharged using the first power supply voltage VSS.

The first and second clocks C1 and C2 serve as two phase clocks. The first and second clocks C1 and C2 are alternately applied to the shift registers SCR1 through SCR[N]. In operation, the gate drive signal of the Nth shift register is used to reset the (N−2)th shift register in the shift register sequence. In the illustrated embodiment, the gate drive signal from the current shift register connected to the first clock Cl is provided to and resets the preceding shift register to which the first clock C1 is also applied. Similarly, the gate drive signal provided from the first of the previous registers connected to the second clock C1 is used to reset the third of the preceding shift registers, which is also connected to receive the second clock C2. Accordingly, the first, second and third of the preceding shift registers do not provide spurious output signals when the current shift register provides its gate drive signal since the (N−2)th shift register is reset in response to the gate drive signal of the Nth shift register. In this case, the (N+1)th shift register and the (N+2)th shift register may be connected with one another so as to reset the (N−1)th shift register and the Nth shift register.

As illustrated in FIG. 6, the gate drive signal GOUT3 provided from the third shift register SRC3 in response to the first clock C1 is used as an input signal to reset the first shift register SRC1, which is also connected to receive the first clock Cl. In this case, the node Q connected to the output terminal OUT of the first shift register SRC1 is discharged to the first power supply voltage VSS.

Similarly, the gate drive signal GOUT4 provided from the fourth shift register SRC4 in response to the second clock C2 is used as an input signal to reset the second shift register SRC2, which is also connected to receive the second clock C2. In this case, the node Q connected to an output terminal OUT of the second shift register SRC2 is discharged to the first power supply voltage VSS.

By extension of the above operation, the (N−2)th shift register can be reset using the output signal of the Nth shift register.

Accordingly, when two phase clocks are employed, no spurious output signal are provided from the next shift register at the time when the gate drive signal is generated by the current shift register. Therefore, even when each shift register is degraded due to extended operation of the gate driver, spurious output signals from shift registers other than the one that is to be activated are reduced and/or eliminated, thereby enhancing the reliability of the product.

Second Embodiment: Three Phase Clocks

Figure 7:
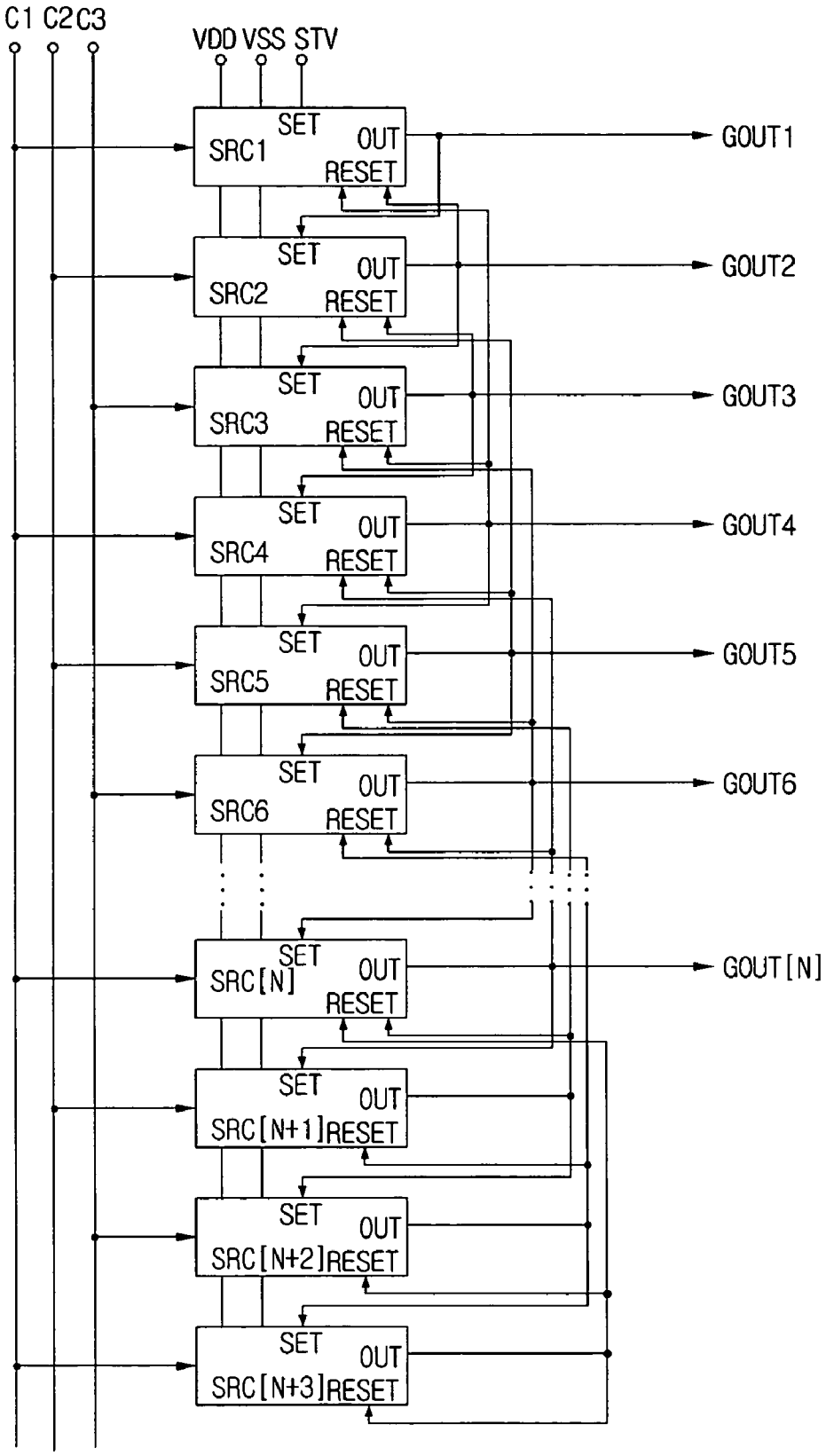
FIG. 7 is a block diagram of a second embodiment of a gate driver constructed in accordance with the teachings of the present invention.
Figure 8:
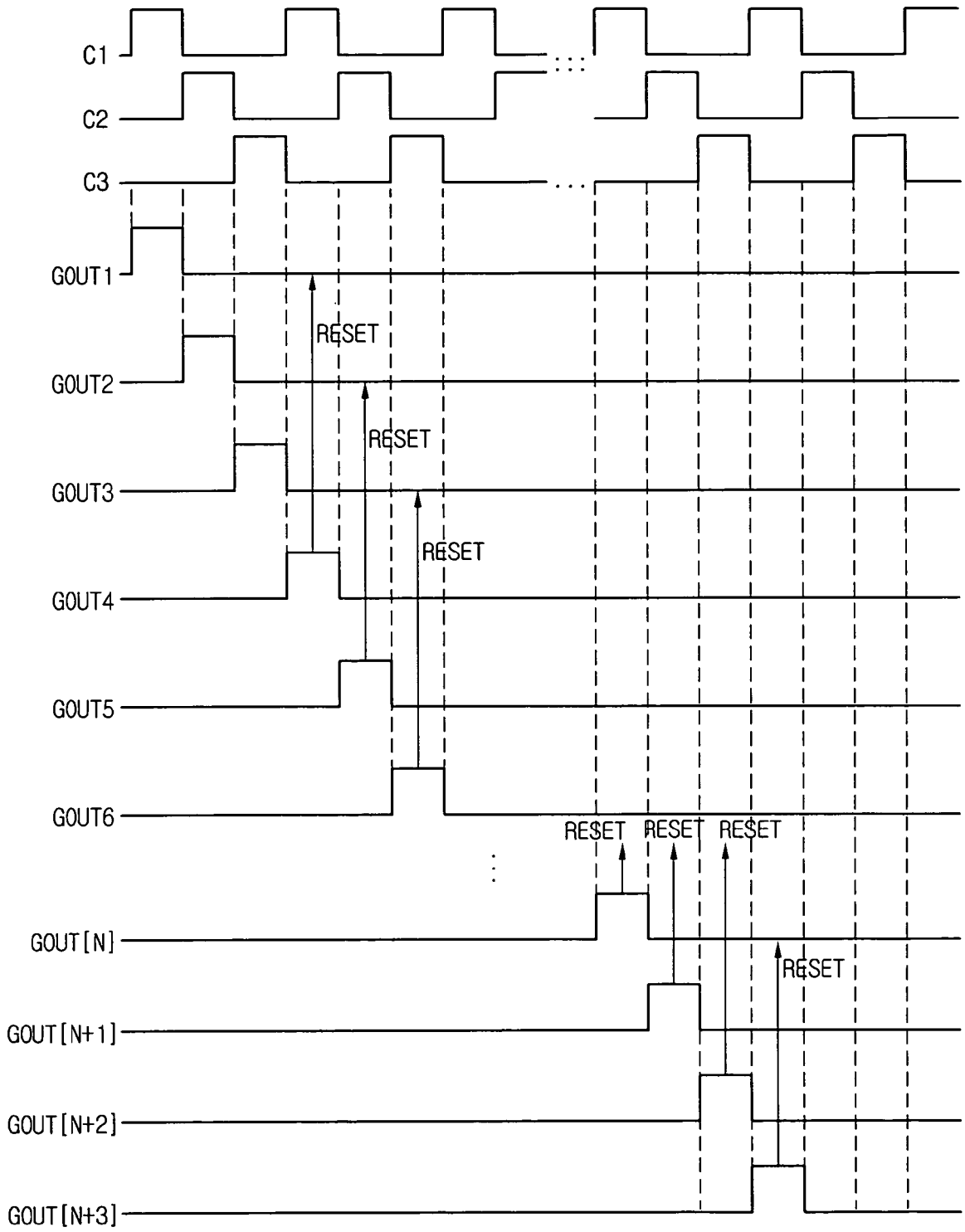
FIG. 8 is a waveform diagram showing various input and output signals associated with the embodiment of the gate driver shown in FIG. 7.

FIG. 7 is a block diagram of a second embodiment of a gate driver, while FIG. 8 is a waveform diagram illustrating various input and output signals associated with the gate driver of FIG. 7. In describing the second embodiment, a description of the same content found in the first embodiment will be omitted for clarity.

Referring to FIG. 7, the shift registers SRC1 through SRC [N+3] are connected to one of three phase clocks, including a first clock C1, a second clock C2 and a third clock C3. More particularly, the first clock C1 is commonly connected to and concurrently applied to the first shift register SRC1, the fourth shift register SRC4, etc. The second clock C2 is commonly connected to and concurrently applied to the second shift register SRC2, the fourth shift register SRC5, etc. The third clock C3 is commonly connected to and concurrently applied to the third shift register SRC3, the fourth shift register SRC6, etc. The shift registers SRC1 through SRC[N] provide corresponding gate drive signals GOUT1 through GOUT[N].

The first gate drive signal GOUT1 is provided from the first shift register SRC1 in response to the first clock signal C1. The first gate drive signal GOUT1 is used as an input signal to a set terminal of the second shift register SRC2.

The second gate drive signal GOUT2 is provided from the second shift register SRC2 in response to the second clock signal C2. The second gate drive signal GOUT2 is provided as an input signal to a set terminal of the third shift register SRC3 and to a reset terminal of the first shift register SRC1. Therefore, the third shift register SRC3 is set and the first shift register SRC1 is reset by the second gate drive signal GOUT2.

The third gate drive signal GOUT3 is provided from the third shift register SRC3 in response to the third clock signal C3. The third gate drive signal GOUT3 also is used as an input signal to a set terminal of the fourth shift register SRC4 and to a reset terminal of the second register SRC2. Therefore, the fourth shift register SRC4 is set and the second shift register SRC2 is reset by the third gate drive signal GOUT3.

Next, the fourth gate drive signal GOUT4 is provided from the fourth shift register SRC4 in response to the first clock signal C1. The fourth gate drive signal GOUT4 is used as an input signal to a set terminal of the fifth shift register SRC5, a reset terminal of the first shift register SRC1 and a reset terminal of the third shift register SRC3. And therefore, the fourth shift register SRC5 is set and the first and third shift registers SRC1 and SCR3 are reset by the fourth gate drive signal GOUT4.

The fifth gate drive signal GOUT5 is provided from the fifth shift register SRC5 in response to the second clock signal C2. The fifth gate drive signal GOUT5 is used as an input signal to a set terminal of the sixth shift register SRC6, a reset terminal of the second shift register SRC2, and a reset terminal of the fourth shift register SRC4. Therefore, the sixth shift register SRC6 is set and the second and fourth shift registers SRC2 and SRC4 are reset by the fifth gate drive signal GOUT5.

The sixth gate drive signal GOUT6 is provided from the sixth shift register SRC6 in response to the third clock signal C3. The sixth gate drive signal GOUT6 also is used as an input signal to a set terminal of the seventh shift register SRC7, a reset terminal of the third shift register SRC3, and a reset terminal of the fifth register SRC5. Therefore, the seventh shift register SRC7 is set and the third and fifth shift registers SRC3 and SRC5 are reset by the sixth gate drive signal GOUT6.

The foregoing interconnection sequence is repeated for the remaining shift registers of the shift register sequence. In the illustrated embodiment, the interconnection sequence is repeated up to the (N+3)th shift register SRC[N+3].

The first, second and third clocks C1, C2 and C3 operate as three phase clocks that are alternately applied to the shift registers. When three phase clock signals are employed, the gate drive signal of the Nth shift register is used to the reset the (N−3)th shift register in the shift register sequence. Meanwhile, (N+1)th, (N+2)th and (N+3)th shift registers also may be used to reset the (N−2)th, (N−1)th and Nth shift registers, respectively.

As illustrated in FIG. 8, a gate drive signal GOUT4 provided from the fourth shift register SRC4 in response to the first clock C1 is used as an input signal to reset the first shift register SRC1, which is also connected to receive the first clock C1. In this case, the node Q connected to the output terminal OUT of the first shift register SRC1 is discharged to the first power supply voltage VSS.

Similarly, a gate drive signal GOUT5 provided from the fifth shift register SRC5 in response to the second clock C2 is used as an input signal that resets the second shift register SRC2, which is also connected to receive the second clock C2. In this case, the node Q connected to the output terminal OUT of the second shift register SRC2 is discharged to the first power supply voltage VSS.

Also, a gate drive signal GOUT6 provided from the sixth shift register SRC6 in response to the third clock C3 is used as an input signal that resets the third shift register SRC3, which is also connected to receive the third clock C3. In this case, the node Q connected to an output terminal OUT of the third shift register SRC3 is discharged to the first power supply voltage VSS.

Through an extension of the foregoing operation, it can be seen that the (N−3)th shift register can be reset using the output signal of the Nth shift register. Accordingly, in the case of three phase clocks, spurious output signals from the next shift register at the time when an output signal is generated from the current shift register are substantially reduced and/or eliminated. Therefore, even when each shift register is degraded due to extended operation of the gate driver, the desired output signal is generated only from the corresponding shift register, thereby enhancing the reliability of the product.

Third Embodiment: Four Phase Clocks

Figure 9:
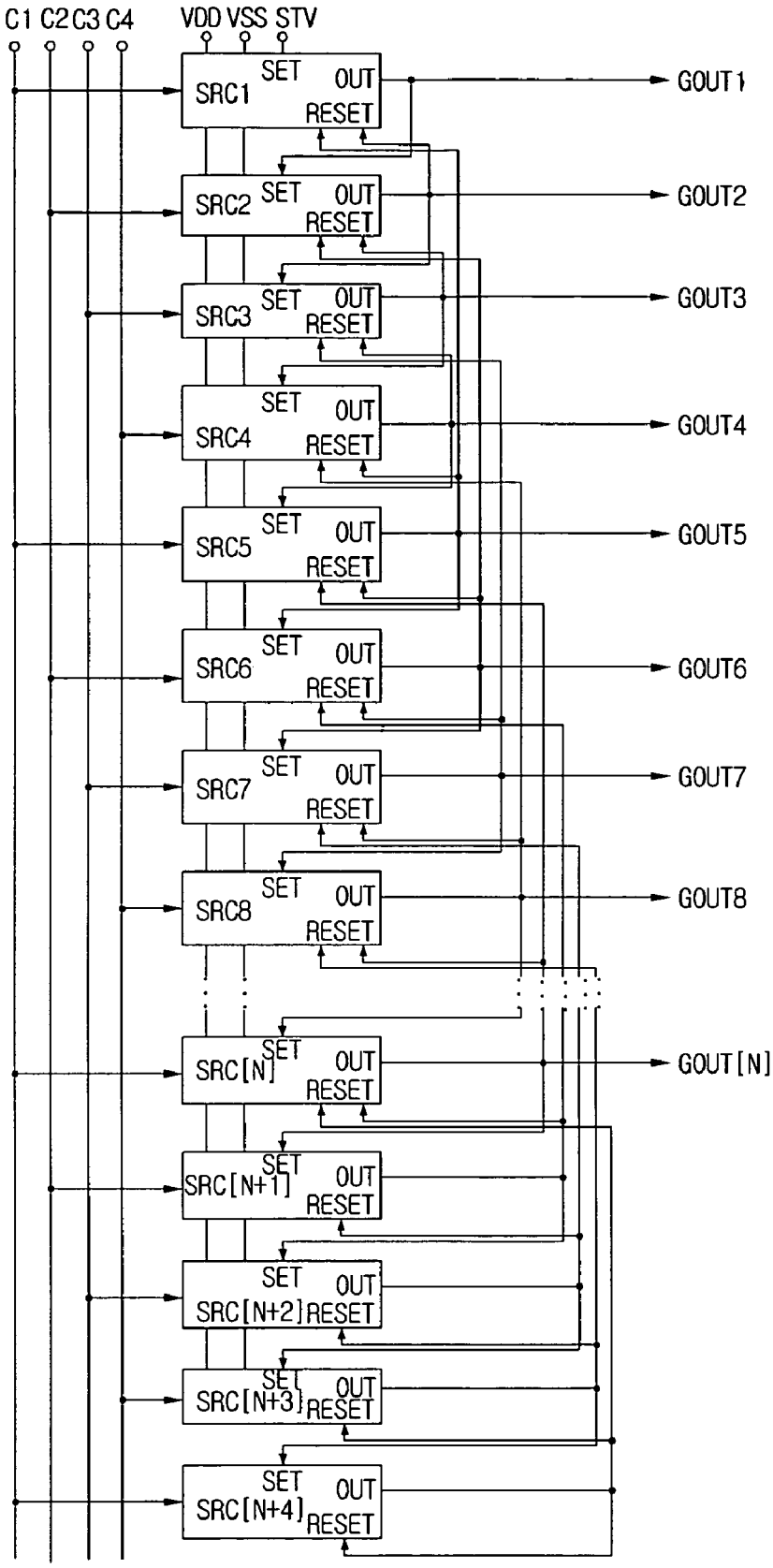
FIG. 9 is a block diagram of a third embodiment of a gate driver constructed in accordance with the teachings of the present invention.
Figure 10:
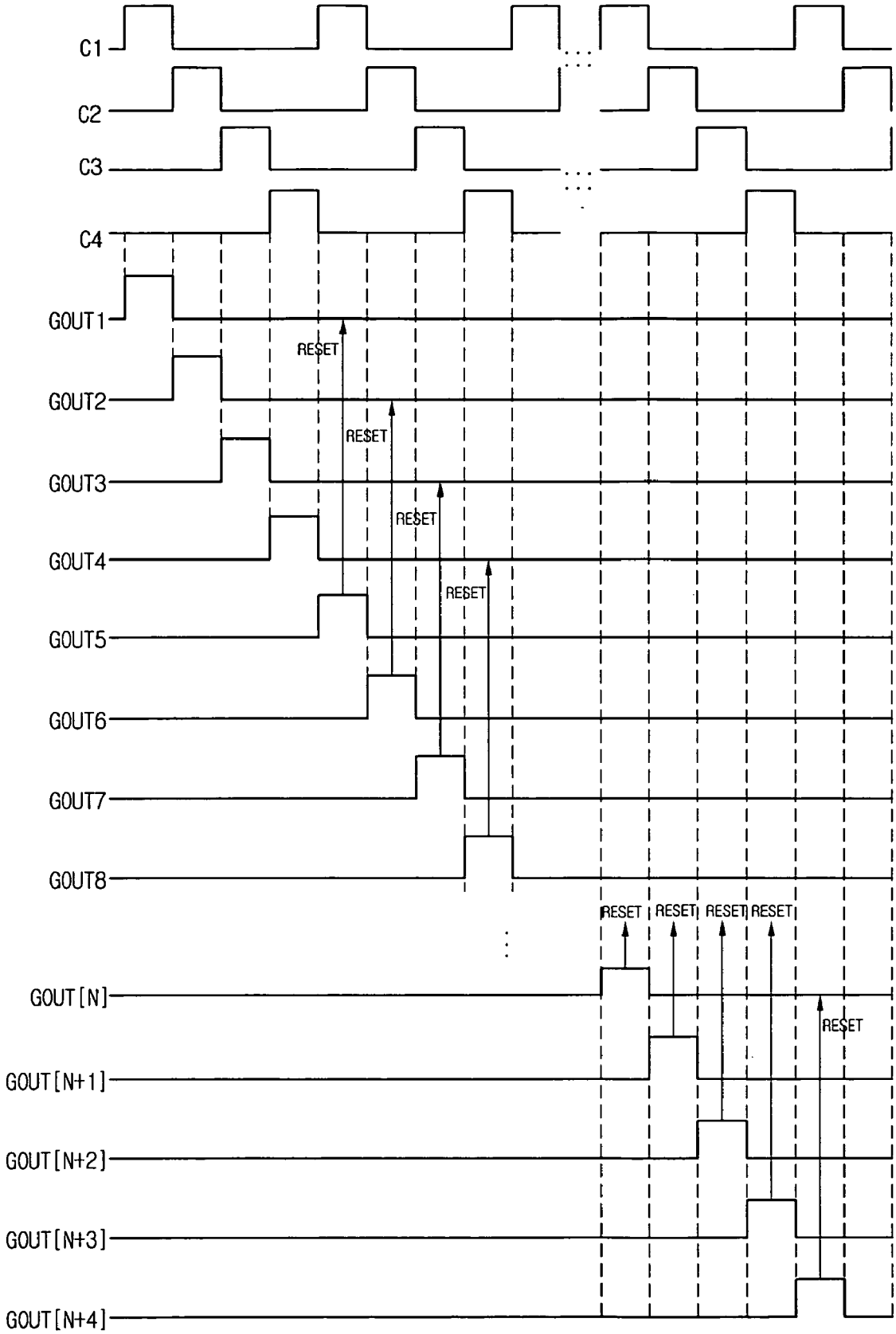
FIG. 10 is a waveform diagram showing various input and output signals associated with the embodiment of the gate driver shown in FIG. 9.

FIG. 9 is a block diagram of a third embodiment of a gate driver, while FIG. 10 is a waveform diagram showing various input and output associated with the gate driver of FIG. 9. In describing the third embodiment, a description of the same content as the first and second embodiments will be omitted for clarity.

Referring to FIG. 9, the shift registers SRC1 through SRC [N+4] are connected to four phase clocks including a first clock C1, a second clock C2, a third clock C3 and a fourth clock C4. More particularly, the first clock C1 is commonly connected to and concurrently applied to the first shift register SRC1, the fifth shift register SRC5, etc. The second clock C3 is commonly connected to and concurrently applied to the second shift register SRC2, the sixth shift register SRC6, etc. The third clock C3 is commonly connected to and concurrently applied to the third shift register SRC3, the seven shift register SRC7, etc. The fourth clock C4 is commonly connected to and concurrently applied to the fourth shift register SRC4, the eighth shift register SRC8, etc.

The shift registers SRC1 through SRC[N] output corresponding gate drive signals GOUTl through GOUT[N]. The first gate drive signal GOUT1 is provided from the first shift register SRC1 in response to the first clock signal C1. The first gate drive signal GOUT1 also is provided as an input signal to a set terminal of the second shift register SRC2. The second shift register SRC2 is thus set by the first gate drive signal GOUT1.

The second gate drive signal GOUT2 is provided from the second shift register SRC2 in response to the second clock signal C2. The second gate drive signal GOUT2 also is provided as an input signal to a set terminal of the third shift register SRC3 and to a reset terminal of the sixth shift register SRC6. Therefore, the third shift register SRC3 is set and the sixth shift register SRC6 is reset by the second gate drive signal GOUT2.

The third gate drive signal GOUT3 is provided from the third shift register SRC3 in response to the third clock signal C3. The third gate drive signal GOUT3 also is used as an input signal to a set terminal of the fourth shift register SRC4 and to a reset terminal of the seventh shift register SRC7. Therefore, the fourth shift register SRC4 is set and the seventh shift register SRC7 is reset by the third gate drive signal GOUT3.

The fourth gate drive signal GOUT4 is provided from the fourth shift register SRC4 in response to the fourth clock signal C4. The fourth gate drive signal GOUT4 also is used as an input signal to a set terminal of the fifth shift register SRC5 and a reset terminal of the eighth shift register SRC8. Therefore, the fifth shift register SRC5 is set and the eighth shift register SRC8 is reset by the fourth gate drive signal GOUT4.

Next, the fifth gate drive signal GOUT5 is provided from the fifth shift register SRC5 in response to the first clock signal C1. The fifth gate drive signal GOUT5 also is provided as an input signal to a set terminal of the sixth shift register SRC6, a reset terminal of the first shift register SRC1 and a reset terminal of the fourth shift register SRC4. Therefore, the sixth shift register SRC6 is set and the first and fourth shift registers SRC1 and SCR4 are reset by the fifth gate drive signal GOUT5.

The sixth gate drive signal GOUT6 is provided from the sixth shift register SRC6 in response to the second clock signal C2. The sixth gate drive signal GOUT6 also is used as an input signal to a set terminal of the seventh shift register SRC7, a reset terminal of the second shift register SRC2, and a reset terminal of the fifth shift register SRC5. Therefore, the seventh shift register SRC7 is set and the second and fifth shift register SRC2 and SRC5 are reset by the sixth gate drive signal GOUT6.

The seventh gate drive signal GOUT7 is provided from the seventh shift register SRC7 in response to the third clock signal C3. The seventh gate drive signal GOUT7 also is used as an input signal to a set terminal of the eighth shift register SRC8, a reset terminal of the third shift register SRC3, and a reset terminal of the sixth register SRC6. Therefore, the eighth shift register SRC8 is set and the third and sixth shift registers SRC3 and SRC6 are reset by the seventh gate drive signal GOUT7.

The eighth gate drive signal GOUT8 is provided from the eighth shift register SRC8 in response to the fourth clock signal C4. The eighth output signal GOUT8 also is used as an input signal to a set terminal of the ninth shift register SRC9, a reset terminal of the fourth shift register SRC4, and a reset terminal of the seventh register SRC7. Therefore, the ninth shift register SRC9 is set and the fourth and seventh shift registers SRC4 and SRC7 are reset by the eighth gate drive signal GOUT8.

The foregoing interconnection sequence is repeated for the remaining shift registers of the shift register sequence. In the illustrated embodiment, the interconnection sequence is repeated up to the (N+4)th shift register SRC[N+4].

The first, second, third and fourth clocks C1, C2, C3 and C4 serve as four phase clocks and are alternately applied to the shift registers of the shift register sequence. When four phase clocks are employed, the gate drive output signal of the Nth shift register may be used to reset the (N−4)th shift register. Meanwhile, (N+1)th, (N+2)th, (N+3)th and (N+4)th shift registers may be further provided to reset the (N−3)th, (N−2)th, (N−1)th and Nth shift registers, respectively.

As illustrated in FIG. 10, the gate drive signal GOUT5 provided from the fifth shift register SRC5 in response to the first clock C1 is used to reset the first shift register SRC1, which is also connected to receive the first clock C1. In this case, the node Q connected to the output terminal OUT of the first shift register SRC1 is discharged to the first power supply voltage VSS.

The gate drive signal GOUT6 provided from the sixth shift register SRC6 in response to the second clock C2 is used to reset the second shift register SRC2, which is also connected to receive the second clock C2. In this case, the node Q connected to the output terminal OUT of the second shift register SRC2 is discharged to the first power supply voltage VSS.

The gate drive signal GOUT7 provided from the seventh shift register SRC7 in response to the third clock C3 is used to reset the third shift register SRC3, which is also connected to receive the third clock C3. In this case, the node Q connected to the output terminal OUT of the third shift register SRC3 is discharged to the first power supply voltage VSS.

The gate drive signal GOUT8 provided from the eighth shift register SRC8 in response to the fourth clock C4 is used to reset the fourth shift register SRC4, which is also connected to receive the fourth clock C4. In this case, the node Q connected to the output terminal OUT of the fourth shift register SRC4 is discharged to the first power supply voltage VSS.

By extension of the above operation, it can be seen that the (N−4)th shift register can be reset in response to the gate drive signal provided by the Nth shift register.

Accordingly, in case of four phase clocks, spurious output signals from the next shift register are reduced and/or eliminated at the time when the gate signal is provided from the current shift register. Therefore, even when each shift register is degraded due to extended operation of the gate driver, the desired output signal is generated solely from the proper shift register in the shift register sequence, thereby enhancing the reliability of the product.

Figure 11:
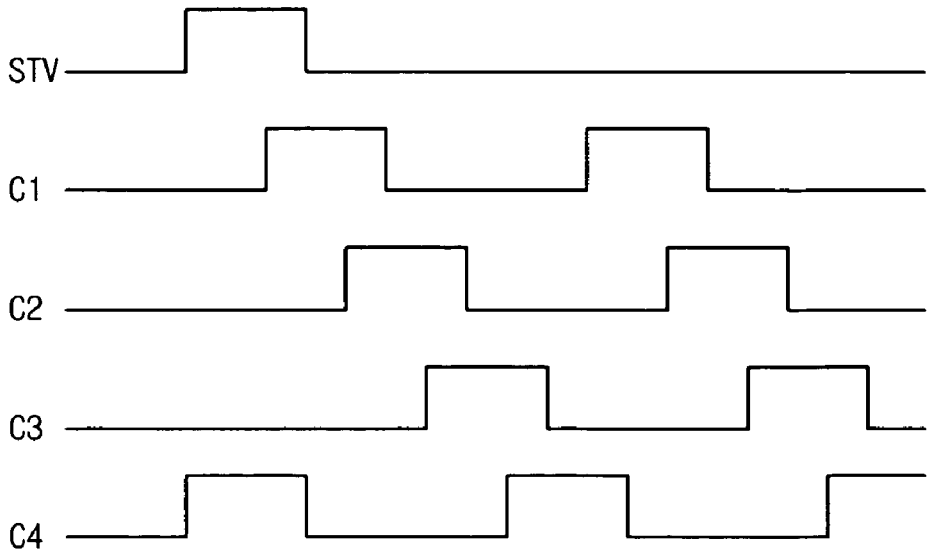
FIG. 11 is a waveform diagram of four phase clocks whose pulses partially overlap one another.

When three or more phase clocks are employed, the clocks may be generated such that their high-state pulses partially overlap one another in time. One such example employing four phase clocks is illustrated in FIG. 11. As shown, the first and second clocks overlap each other, the second and third clocks overlap each other, and the third and fourth clocks overlap each other. The overlapping area between the clocks may be selected based on design criterion. If the clocks overlap each other by half of a clock period, the first and third clocks will be synchronized with each other and the second and fourth clocks will be synchronized with each other.

Figure 12:
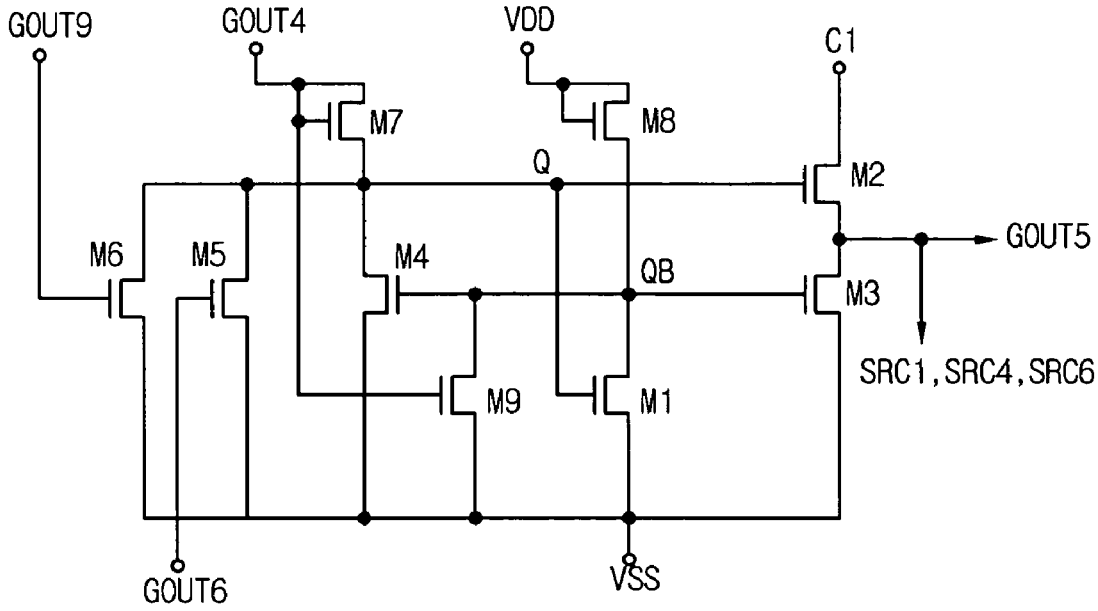
FIG. 12 is a circuit diagram of one embodiment of a shift register constructed in accordance with teachings of the present invention.

FIG. 12 is a circuit diagram of one embodiment of the shift registers that may be used to construct the embodiment of the gate drivers noted above. All of the shift registers of a single gate driver embodiment may have the same structure. For convenience of description, the fifth shift register SRC5 using the four phase clocks is used in the example of FIG. 12.

Referring to FIG. 12, the fifth shift register SRC5 includes second and third transistors M2 and M3 for controlling the fifth gate drive signal GOUT5. The second transistor M2 includes a gate connected to a node Q, a drain connected to the first clock C1, and a source connected to the fifth gate drive signal GOUT5. The third transistor M3 includes a gate connected to a node QB, a drain connected to the fifth gate drive signal GOUT5, and a source connected to the first power supply voltage VSS. Accordingly, the second transistor M2 is switched between a conductive and non-conductive state in response to the charge/discharge of the node Q, and the third transistor M3 is switched between a conductive and non-conductive state in response to the charge/discharge of the node QB.

The node Q is charged by the fourth gate drive signal GOUT4 of the fourth shift register SRC4. Also, the Q node is discharged by the voltage VSS provided by the first power supply. As shown, voltage VSS is provided through a fifth transistor M5 when the fifth transistor is driven to a conductive state by the sixth gate drive signal GOUT6 of a sixth shift register SRC6 and through a fourth transistor M4 when it is driven to a conductive state by the voltage at node QB. The fifth transistor M5 includes a gate that is connected to the gate drive signal GOUT6 of the sixth shift register SRC6, a drain that is connected to node Q, and a source connected to receive the voltage VSS from the first power supply. The fourth transistor M4 includes a gate connected to node QB, a drain connected to node Q, and a source connected to the receive the voltage VSS from the first power supply. When the fifth transistor M5 is driven to a conductive state by the gate drive signal GOUT6 of the sixth shift register SRC6, node Q is discharged approximately to the first power supply voltage VSS. When node QB is charged using the second power supply voltage VDD, the fourth transistor M4 is driven to a conductive state through the charging of node QB, while node Q is discharged approximately to the first power supply voltage VSS.

Also, node Q can be discharged using the first power supply voltage VSS when the sixth transistor M6 is driven to a conductive state by the first gate drive signal GOUT1 of the first shift register SRC1. The sixth transistor M6 includes a gate connected to the gate drive signal GOUT9 of the ninth shift register SRC9, a drain connected to node Q, and a source connected to receive the first power supply voltage VSS.

The shift register circuit may be manufactured in a monolithic substrate. In such instances the width of the sixth transistor M6 optionally may be greater or smaller than the width of the fifth transistor M5. For example, the sixth transistor M6 may have 0.5~1.5 times the width of the fifth transistor M5.

The charge at node Q of this embodiment is reset in response to the gate drive signal GOUT9 of the ninth shift register SRC9. More particularly, the fifth shift register SRC5 to which the first clock C1 is applied is reset by the gate drive signal GOUT9 that is generated by the ninth shift register SRC9 in response to the first clock C1. When the gate drive signal (e.g., GOUT1) is generated by the shift register (e.g., the first shift register SRC9) before the fifth shift register SRC5 in response to the first clock C1, the fifth gate drive signal GOUT5 is inhibited from being provided from the fifth shift register SRC5 (to which the first clock is also applied), even under extended operation of the gate driver. Since all the shift registers following the current shift register in the shift register sequence are reset, the next shift register in the sequence that is connected to the same phase clock does not generate any output signal at the time when the current shift register provides its gate drive signal.

Node QB is charged approximately to the second power supply voltage VDD, and is discharged approximately to the first power supply voltage VSS that is supplied through the first transistor M1 switched on by the Q node. The first transistor M1 includes a gate connected to node Q, a drain connected to node QB, and a source connected to receive the first power supply voltage VSS. When node Q is charged in response to a positive voltage of the fourth gate drive signal GOUT4 of the fourth shift register SRC4, the first transistor M1 is driven to a conductive state. Similarly, a positive voltage of the fourth gate drive signal GOUT4 discharges node QB to a voltage level that is approximately equal to the first power supply voltage VSS.

Node QB is discharged to a voltage level approximately equal to voltage VSS when a ninth transistor M9 is driven to a conductive state by the fourth gate drive signal GOUT4 of the fourth shift register SRC4. The ninth transistor M9 includes a gate connected to the fourth gate drive signal GOUT4 of the fourth shift register SRC4, a drain connected to node QB, and a source connected to receive the first power supply voltage VSS.

A seventh transistor M7 is also employed. The seventh transistor M7 includes a gate and a drain connected to the gate drive signal GOUT4 of the fourth shift register SRC4 and a source connected to node Q. Transistor M7 may be provided to prevent a reverse current flow from the Q node to the gate drive signal GOUT4 of the fourth shift register SRC4.

Also, an eighth transistor M8 may be employed. The eighth transistor M8 may include a gate and a drain connected commonly to the second power supply voltage VDD and a source connected to node QB. Transistor M8 may be provided to prevent a reverse current flow from node QB to the second power supply voltage VDD.

Accordingly, by an output signal outputted by a predetermined clock, the previous shift register to which the predetermined clock is also applied can be reset. Accordingly, an output signal can be outputted only at a desired time by the predetermined time.

As described above, the gate driver includes a plurality of shift registers, and the previous shift resister to which a predetermined clock is applied is reset using an output signal that is outputted from the next shift register by the predetermined clock. Accordingly, a plurality of output signals can be prevented from being simultaneously outputted from the shift registers to which the identical clock is applied. Therefore, a corresponding output signal can be outputted from the gate driver only at a desired time. Accordingly, the reliable output signal can be obtained.

Consequently, the malfunction of the device can be prevented and the lifetime of the device can be extended.

Also, the screen flickering that may occur due to a plurality of output signals can be prevented and thus the image quality can be enhanced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A gate driver comprising:

a plurality of shift registers connected in cascade with one another;

two or more-phase clocks, one of the two or more-phase clocks being applied to each shift register;

where a first previous shift register to which the one of the two or more-phase clocks is applied is reset using an output signal from a current shift register to which the same clock as the one of the two or more-phase clocks is applied, wherein the output signal from the current shift register is used to reset a second previous shift register in response to a clock as one of the two or more-phase clocks supplied to the second previous shift register, wherein the clock supplied to the second previous shift register is different from the clock supplied to the current shift register, wherein a first power supply voltage and a second power supply voltage are supplied to the plurality of shift registers, the first power supply voltage is a voltage of a low level and the second power supply voltage is a voltage of a high level, where the shift registers have a number N of shift registers, wherein each shift register includes a control portion and an output portion, wherein the control portion includes:

a first transistor which responds to an output signal from a (N+a, a=2,3,4)th next shift register is connected between a first power supply line for the first power supply voltage and a first node, a second transistor which responds to an output signal from a first next shift register is connected between the first node and the first power supply line, a third transistor which responds to an output signal from the second previous shift register is connected between a supply line for the output signal from the second previous shift register and the first node, a fourth transistor which responds to a second node is connected between the first node and the first power supply line, a fifth transistor which responds to the output signal from the second previous shift register is connected between the second node and the first power supply line, a sixth transistor which responds to the second power supply voltage is connected between a second power supply line for the second power supply voltage and the second node, a seventh transistor which responds to the first node is connected between the second node and the first power supply line, wherein the output portion includes:

an eighth transistor which responds to the first node is connected between a supply line for the clock supplied to each shift register and an output line for the output signal, a ninth transistor which responds to the second node is connected between the first power supply line and the output line, wherein the output signal from the current shift register is used to set a next shift register in response to a clock being the same as the one of the two or more-phase clocks supplied to the first previous shift register, wherein the first node connected to the output line of shift register is charged using the second power supply voltage when each shift register is set, the first node is discharged using the first power supply voltage when the shift register is reset.

2. gate driver according to claim 1, where the two or more-phase clocks are two phase clocks and wherein the α is 2, and the (N−2)th shift register to which the one of the two phase clocks is applied is reset by an output signal from the Nth shift register to which the same clock as the one of the two phase clocks is applied, wherein the output signal from the Nth shift register is used to set a (N+1)th shift register in response to a clock as one of the two phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

3. The gate driver according to claim 1, where the two or more-phase clocks are three phase clocks and wherein the α is 3, and the (N−3)th shift register to which the one of the three phase clocks is applied is reset by an output signal from the Nth shift register to which the same clock as the one of the three phase clocks is applied, wherein the output signal from the Nth shift register is used to set a (N+1)th shift register in response to a clock as one of the three phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

4. The gate driver according to claim 1, where the two or more-phase clocks are four phase clocks and wherein the α is 4, and the (N−4)th shift register to which the one of the four phase clocks is applied is reset by an output signal from the Nth shift register to which the same clock as the one of the three phase clocks is applied, wherein the output signal from the Nth shift register is used to set a (N+1)th shift register in response to a clock as one of the four phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

5. The gate driver according to claim 1, where the two or more-phase clocks are generated in synchronization with a horizontal synchronization signal.

6. The gate driver according to claim 1, where the gate driver comprises three or more phase clocks that partially overlap pulse widths of one another.

7. The gate driver according to claim 1, wherein each of the shift registers comprises a transistor switched having a conductive state that is dependent on an output signal from one of the second shift register following the current shift register, the third shift register following the current shift register and the fourth shift register following the current shift register.

8. A display device comprising:

a display panel comprising a plurality of pixels arranged in a matrix;

a data driver supplying pixel drive signals to data lines, the data lines being connected for driving individual pixels of at least one row of pixels with a corresponding pixel drive signals; and a gate driver supplying gate drive signals to gate lines of the matrix, each gate line being connected for concurrently driving at least one row of pixels with a respective gate drive signal, the gate driver comprising a plurality of shift registers connected in cascade with one another;

two or more-phase clocks, one of the two or more-phase clocks being applied to each shift register;

where a first previous shift register to which the one of the two or more-phase clocks is applied is reset using an output signal from a current shift register to which the same clock as the one of the two or more-phase clocks is applied, wherein the output signal from the current shift register is used to reset a second previous shift register in response to a clock as one of the two or more-phase clocks supplied to the second previous shift register, wherein the clock supplied to the second previous shift register is different from the clock supplied to the current shift register, wherein a first power supply voltage and a second power supply voltage are supplied to the plurality of shift registers, the first power supply voltage is a voltage of a low level and the second power supply voltage is a voltage of a high level, where the shift registers have a number N of shift registers, wherein each shift register includes a control portion and an output portion, wherein the control portion includes:

a first transistor which responds to an output signal from a (N+a, a=2,3, 4)th next shift register is connected between a first power supply line for the first power supply voltage and a first node, a second transistor which responds to an output signal from a first next shift register is connected between the first node and the first power supply line, a third transistor which responds to an output signal from the second previous shift register is connected between a supply line for the output signal from the second previous shift register and the first node, a fourth transistor which responds to a second node is connected between the first node and the first power supply line, a fifth transistor which responds to the output signal from the second previous shift register is connected between the second node and the first power supply line, a sixth transistor which responds to the second power supply voltage is connected between a second power supply line for the second power supply voltage and the second node, a seventh transistor which responds to the first node is connected between the second node and the first power supply line, wherein the output portion includes:

an eighth transistor which responds to the first node is connected between a supply line for the clock supplied to each shift register and an output line for the output signal, a ninth transistor which responds to the second node is connected between the first power supply line and the output line, wherein the output signal from the current shift register is used to set the first next shift register in response to a clock being the same as the one of the two or more-phase clocks supplied to the first previous shift register, wherein the first node connected to the output line of shift register is charged using the second power supply voltage when each shift register is set, the first node is discharged using the first power supply voltage when the shift register is reset.

9. The display device according to claim 8, where the two or more-phase clocks are two phase clocks and wherein the $\alpha$ is 2, and the (N−2)th shift register to which the one of the two phase clocks is applied is reset by an output signal from the Nth shift register to which the same clock as the one of the two phase clocks is applied, wherein the output signal from the Nth shift register is used to set a (N+1)th shift register in response to a clock as one of the two phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

10. The display device according to claim 8, where the two or more-phase clocks are three phase clocks and wherein the $\alpha$ is 3, and the (N−3) th shift register to which the one of the three phase clocks is applied is reset by an output signal from the Nth shift register to which the same clock as the one of the three phase clocks is applied, wherein the output signal from the Nth shift register is used to set a (N+1)th shift register in response to a clock as one of the three phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

11. The display device according to claim 8, where the two or more-phase clocks are four phase clocks and wherein the $\alpha$ is 4, and the (N−4)th shift register to which the one of the four phase clocks is applied is reset by an output signal from the Nth shift register to which the same clock as the one of the three phase clocks is applied, wherein the output signal from the Nth shift register is used to set a (N+1)th shift register in response to a clock as one of the four phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

12. The display device according to claim 8, where the two or more-phase clocks are generated in synchronization with a horizontal synchronization signal.

13. The display device according to claim 8, where the gate driver comprises three or more phase clocks that partially overlap pulse widths of one another.

14. The display device according to claim 8, wherein each of the shift registers comprises a transistor switched having a conductive state that is dependent on an output signal from one of the second shift register following the current shift register, the third shift register following the current shift register and the fourth shift register following the current shift register.

15. The display device according to claim 8, where the gate driver is integrated with the display panel in a semiconductor manufacturing process.

16. A method of driving a gate driver of a display where the gate driver is comprised of a plurality of shift registers connected in cascade with one another, the method comprising:

using two or more-phase clocks, one of the two or more-phase clocks is applied to each shift register; and resetting a first previous shift register to which the one of the two or more-phase clocks is applied using an output signal from a current shift register to which the same clock as the one of the two or more-phase clocks is applied, wherein the output signal from the current shift register is used to reset a second previous shift register in response to a clock as one of the two or more-phase clocks supplied to the second previous shift register, wherein the clock supplied to the second previous shift register is different from the clock supplied to the current shift register, wherein a first power supply voltage and a second power supply voltage are supplied to the plurality of shift registers, the first power supply voltage is a voltage of a low level and the second power supply voltage is a voltage of a high level, where the shift registers have a number N of shift registers, wherein each shift register includes a control portion and an output portion, wherein the control portion includes:

a first transistor which responds to an output signal from a (N+a, a=2,3, 4)th next shift register is connected between a first power supply line for the first power supply voltage and a first node, a second transistor which responds to an output signal from a first next shift register is connected between the first node and the first power supply line, a third transistor which responds to an output signal from the second previous shift register is connected between a supply line for the output signal from the second previous shift register and the first node, a fourth transistor which responds to a second node is connected between the first node and the first power supply line, a fifth transistor which responds to the output signal from the first second previous shift register is connected between the second node and the first power supply line, a sixth transistor which responds to the second power supply voltage is connected between a second power supply line for the second power supply voltage and the second node, a seventh transistor which responds to the first node is connected between the second node and the first power supply line, wherein the output portion includes:

an eighth transistor which responds to the first node is connected between a supply line for the clock supplied to each shift register and an output line for the output signal, a ninth transistor which responds to the second node is connected between the first power supply line and the output line, wherein the output signal from the current shift register is used to set the first next shift register in response to a clock being the same as the one of the two or more-phase clocks supplied to the first previous shift register, wherein the first node connected to the output line of shift register is charged using the second power supply voltage when each shift register is set, the first node is discharged using the first power supply voltage when the shift register is reset.

17. The method according to claim 16, where the shift registers comprises N shift registers and the $\alpha$ is 2, the method further comprising:

using two phase clocks, one of the two phase clocks being applied to each shift register; and resetting the (N−2)th shift register to which the one of the two phase clocks is applied using an output signal from the Nth shift register to which the same clock as the one of the two phase clocks is applied, wherein the output signal from the Nth shift register is used to set a (N+1)th shift register in response to a clock as one of the two phase clocks supplied to the (N+1)th shift register, wherein the clock supplied to the (N+1)th shift register is different from the clock supplied to the Nth shift register, wherein the output signal from the Nth shift register is used to reset a (N−b 1)th shift register in response to the clock supplied to the (N+1)th shift register.

18. The method according to claim 16, where the sequence of shift registers comprises N shift registers and the $\alpha$ is 3, the method further comprising:

using three phase clocks one of the three phase clocks being applied to each shift register; and resetting the (N−3)th shift register to which the one of the three phase clocks is applied using an output signal from the Nth shift register to which the same clock as the one of the two phase clocks is applied, wherein the output signal from the Nth shift register is used to set a (N+1)th shift register in response to a clock as one of the three phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

19. The method according to claim 16, where the sequence of shift registers comprises N shift registers and the $\alpha$ is 4, the method further comprising:

using four phase clocks one of the four phase clocks being applied to each shift register; and resetting the (N−4)th shift register to which the one of the four phase clocks is applied using an output signal from the Nth shift register to which the same clock as the one of the two phase clocks is applied, wherein the output signal from the Nth shift register is used to set a (N+1)th shift register in response to a clock as one of the four phase clocks supplied to the (N+1)th shift register, wherein the clock supplied to the (N+1)th shift register is different from the clock supplied to the Nth shift register, wherein the output signal from the Nth shift register is used to reset a (N−1)th shift register in response to the clock supplied to the (N+1)th shift register.

* * * * *